United States Patent [19]

La Spisa

[11] Patent Number: 4,457,266

[45] Date of Patent: Jul. 3, 1984

[54] BOILER CONTROL

[75] Inventor: Ronald J. La Spisa, Bartlesville, Okla.

[73] Assignee: Phillips Petroleum Company, Bartlesville, Okla.

[21] Appl. No.: 519,654

[22] Filed: Aug. 2, 1983

[51] Int. Cl.[3] ..... F22D 5/26

[52] U.S. Cl. ..... 122/451.1; 122/414; 122/504; 236/14

[58] Field of Search ..... 122/414, 451 R, 451 S, 122/451.1, 451.2, 448 A, 504; 236/14, 15 R

[56] References Cited

U.S. PATENT DOCUMENTS

| | | | |
|---|---|---|---|
| 3,042,007 | 7/1962 | Chien et al. | 122/448 |
| 3,417,737 | 12/1968 | Shinskey et al. | 122/448 |
| 4,054,780 | 10/1977 | Bartley et al. | 364/106 |
| 4,242,989 | 1/1981 | Chamberlain | 122/451 R |
| 4,265,263 | 5/1981 | Hobbs | 137/2 |
| 4,373,663 | 2/1983 | Hammer | 122/448 R |

FOREIGN PATENT DOCUMENTS

| | | | |
|---|---|---|---|
| 131306 | 11/1978 | Japan | 122/451.1 |

OTHER PUBLICATIONS

Liptak, *Instrument Engineers Handbook,* vol. 11, pp. 1411-1414.

*Primary Examiner*—Edward G. Favors

[57] ABSTRACT

The control of the actual liquid level in a boiler is accomplished by using the actual enthalpy of the fluid in the boiler to generate a signal which is utilized to bias the output from a conventional level controller in such a manner that swell and shrink causes by disturbances is compensated for and a desired liquid level is maintained in the boiler.

6 Claims, 1 Drawing Figure

BOILER CONTROL

Figure 1:
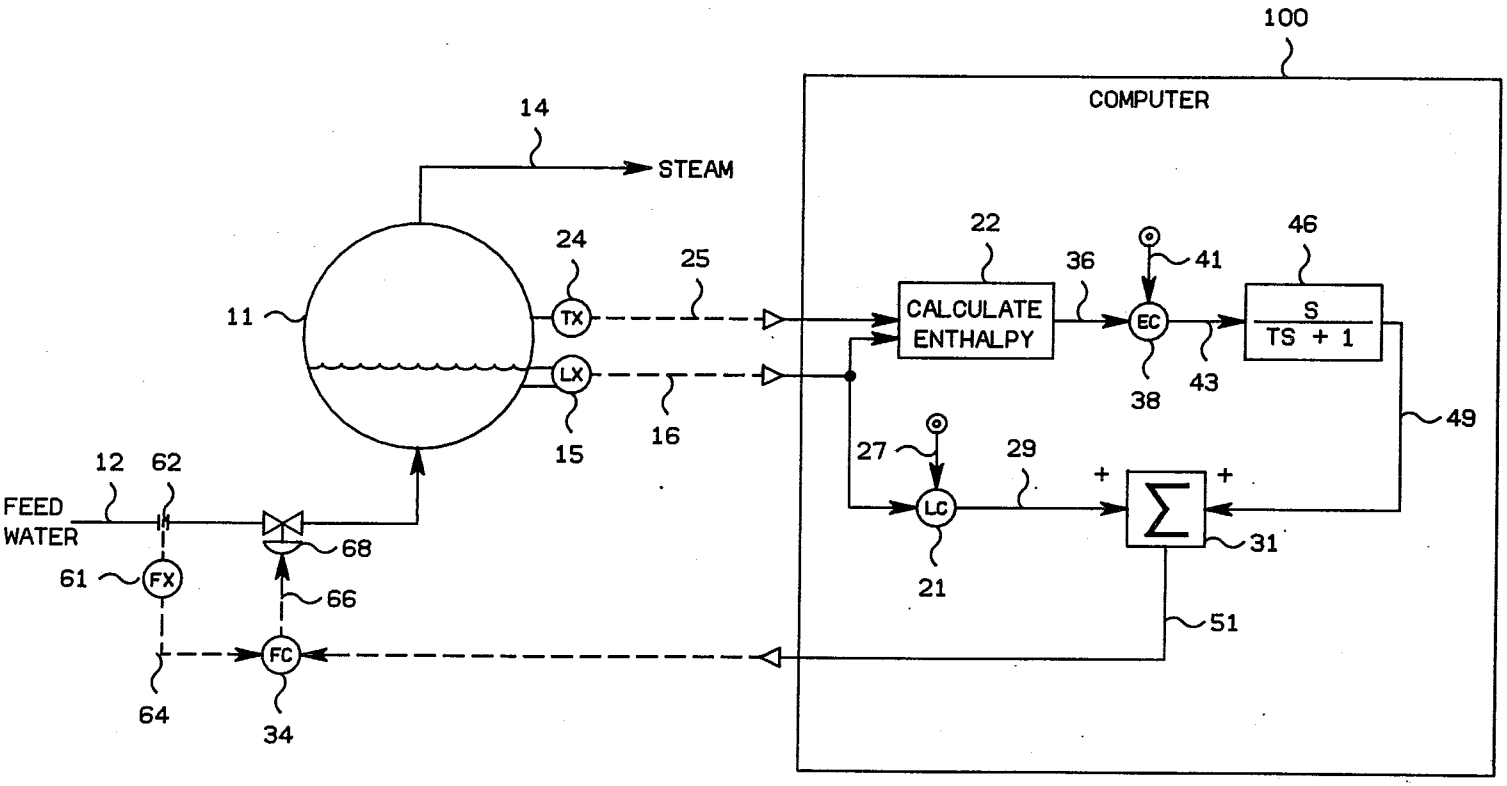

This invention relates to control of a boiler. In one aspect, this invention relates to method and apparatus for maintaining a desired liquid level in a boiler.

Boilers are utilized in many processes to supply steam. In general, it is desirable to maintain a particular liquid level in the boiler and conventional level control is often utilized to accomplish this. However, phenomena known as "shrink" and "swell" make it difficult to maintain a desired liquid level in a boiler using conventional level control where the control action is based on liquid level in the boiler.

The term "shrink" is a conventional term which refers to the affect of an increase in pressure on the liquid level in the boiler. When steam demand decreases, the result is an increase in pressure in the boiler and the water in the drum shrinks i.e., the water level is reduced.

The term "swell" is also a conventional term which refers to the affect on the water level of an increase in the load on the boiler i.e., an increase in steam demand. Pressure in the drum decreases when steam demand increases due to an increase in demand and the water in the drum swells i.e., the level of the water increases.

The phenomenon of shrink and swell can cause exactly the opposite from the desired control action to be taken when conventional level control is being utilized to control the liquid level in a boiler. As an example, when the steam flow increases due to a increase in demand it is necessary to increase the flow of the feedwater to the boiler. However, the first thing that happens is that pressure in the drum decreases due to the increased steam flow and the water in the drum swells. This causes the level controller to sense that the level is too high and the level controller will begin to cut back on the feedwater which is the exact opposite of the desired response.

It is thus an object of this invention to provide method and apparatus for controlling the liquid level in a boiler which compensates for the phenomena of shrink and swell.

In accordance with the present invention, method and apparatus is provided whereby the actual enthalpy of the fluid in the boiler is utilized to generate a signal which is utilized to bias the output from a conventional level controller in such a manner that swell and shrink caused by disturbances is compensated for. It has been found that control based on the actual enthalpy of the fluid in the boiler provides a very quick response and enables a desired liquid level to be maintained even when steam demand is changing rapidly.

Other objects and advantages of the invention will be apparent from the foregoing brief description of the invention and the claims as well as the detailed description of the drawing which is briefly described as follows:

FIG. 1 is a diagrammatic illustration of a boiler and the associated control system of the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals in not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 700 Process Control System from Applied Automation, Inc., Bartlesville, Oklahoma.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, there is illustrated a conventional boiler 11. Feedwater is supplied to the boiler 11 through conduit means 12. Steam is removed from the boiler 11 through conduit means 14. Other conventional equipment which would normally be associated with the boiler 11, such as the burners and fuel system, are not illustrated since such additional equipment plays no part in the description of the present invention.

In general, control of the liquid level in the boiler 11 is accomplished by using process measurements to establish a control signal for the flow rate of the feedwater. The process measurements will first be described and then the generation and use of the control signal will be described. Thereafter, a preferred method for calculating the enthalpy for the fluid in the boiler 11 will be described.

Level transducer 15, which is operably connected to the boiler 11 so as to be able to sense the liquid level in the boiler 11, provides an output signal 16 which is representative of the actual liquid level in the boiler 11. Signal 16 is provided from the level transducer 15 to computer 100 and is specifically provided to both the level controller 21 and the calculate enthalpy block 22.

Temperature transducer 24 in combination with a temperature sensing device such as a thermocouple, which is operably located in the boiler 11, provides an output signal 25 which is representative of the temperature of the fluid in the boiler 11. Signal 25 is provided from temperature transducer 24 as an input to computer 100 and is specifically provided to the calculate enthalpy block 22.

The level controller 21 is also supplied with a set point signal 27 which is representative of the desired liquid level in the boiler 11. A typical value for signal 27 is a liquid level which would maintain a volume of liquid equal to about 15% of the total volume of the boiler 11. In response to signals 16 and 27, the level controller 21 provides an output signal 29 which is responsive to the difference between signals 16 and 27. Signal 29 is scaled so as to be representative of the flow rate of the feedwater flowing through conduit means 12 required to maintain a desired liquid level in the boiler 11. Signal 29 is provided from the level controller 21 as a first input to the summing block 31.

It is noted, that if conventional level control were being utilized, signal 29 would be provided directly to the flow controller 34. However, this would not provide the compensation for shrink and swell which is provided by the present invention. Thus, a biasing term, which is described more fully hereinafter, is added to signal 29 in the summing block 31 to accomplish the desired compensation for shrink and swell.

In response to signals 16 and 25, the actual enthalpy of the fluid in the boiler 11 is calculated in the calculate enthalpy block 22 as will be described more fully hereinafter. Signal 36, which is representative of the actual enthalpy of the fluid in the boiler 11, is provided from the calculate enthalpy block 22 as the process variable input to the enthalpy controller 38.

The enthalpy controller 38 is also provided with a set point signal 41 which is representative of the desired enthalpy that the fluid in the boiler 11 would have if the actual liquid level in the boiler 11 was equal to the liquid level represented by signal 27. In response to signals 36 and 41, the enthalpy controller 38 provides an output signal 43 which is responsive to the difference between signals 36 and 41. Signal 43 is scaled so as to be representative of any change in the flow rate represented by signal 29 required to maintain the actual enthalpy of the fluid in the boiler 11 substantially equal to the desired enthalpy represented by signal 41. Signal 43 is provided from the enthalpy controller 38 as an input to the realizable differentiator block 46.

the differentiator block 46 is conventional. In the equation illustrated in the derivative block 46, S is the Laplace operator and T is a time constant. The time T is chosen as the average time required for the affect of a shrink of swell to dissipate. A typical value for T is 200 seconds. The output signal from the differentiator block 46 will be representative of the derivative of signal 43. Signal 49, which is representative of such derivative, is supplied from the differentiator block 46 as an input to the summing block 31. Signal 49 is considered a biasing signal which compensates for the affect of shrink and swell.

Signals 29 and 49 are summed in the summing block 31 to establish signal 51 which is representative of the flow rate of the feedwater required to maintain the desired liquid level in the boiler 11. Signal 51 is provided from computer 100 as the set point input to flow controller 34. It is noted that if enthalpy is not changing due to a change in steam demand, signal 49 wil be equal to zero and signal 29 will be supplied directly as signal 51 to the flow controller 34.

Flow transducer 61 in combination with the flow sensor 62, which is operably located in conduit means 12, provides an output signal 64 which is representative of the actual flow rate of the feedwater to conduit means 12. Signal 64 is provided from the flow transducer 61 as the process variable input to the flow controller 34.

In response to signals 51 and 64, the flow controller 34 provides an output signal 66 which is responsive to the difference between signals 51 and 64. Signal 66 is scaled so as to be representative of the position of the control valve 68, which is operably located in conduit means 12, required to maintain the actual flow rate of the feedwater through conduit means 12 substantially equal to the desired flow rate represented by signal 51. Signal 66 is provided from the flow controller 34 as the control signal for control valve 68 and control valve 68 is manipulated in response thereto.

In summary with respect to FIG. 1, it has been found that a comparison of the actual enthalpy to the desired enthalpy of the fluid in the boiler 11 when the liquid level in the boiler 11 is at a desired level can be utilized to generate a bias signal for the output of a conventional level controller. This bias signal is utilized to compensate for shrink and swell and is present only when a change in enthalpy occurs which is the time period when the phenomena of shrink and swell will occur.

The average enthalpy of the fluid in the boiler 11 can be calculated in a number of conventional techniques. A preferred technique is described herinafter. However, the invention is not limited to any particular technique for calculating enthalpy.

The enthalpy of the fluid in the boiler 11 ($h_{avg}$) is given by equation (1)

$$h_{avg} = \frac{(h_V)(M_V) + (h_L)(M_L)}{M_V + M_L} \quad (1)$$

where $h_V$=the enthalpy of the vapor in the boiler 11;

$M_V$=the mass of vapor in the boiler 11;

$h_L$=the enthalpy of the liquid in the boiler 11; and $M_L$=the mass of the liquid in the boiler 11.

The manner in which $h_V$, $h_L$, $M_V$ and $M_L$ are determined is as follows:

The value of $H_V$ and $H_L$ may be determined directly from steam tables based on the temperature in the boiler 11 represented by signal 25. Such steam tables may be found in a number of references. A particular reference is "Steam Its Generation and Use" published by the Babcock and Wilcox Company (1955, page 10-A1). In these tables, the enthalpy of both the liquid and the vapor in the boiler 11 can be read directly based on the temperature in the boiler 11. For a computer implementation, conventional programs are available which duplicate the steam table information.

The steam tables can also be utilized to determine the specific volume of the liquid contained in the boiler 11 and the specific volume of the vapor contained in the boiler 11 based on the temperature in the boiler 11. Again, conventional computer programs are preferably utilized to generate this information based on steam tables.

The volume of liquid contained in the boiler 11 ($V_L$) is given by equation (2)

$$V_L = (\text{Liquid Level})(\text{Conv. Factor}) \quad (2)$$

where Liquid Level=the actual liquid level in the boiler 11 (signal 25); and Conv. Factor=a conversion factor which converts the Liquid Level to a volume. The conversion factor is derived based on the geometry of the boiler.

The volume of the vapor in the boiler 11 ($V_V$) is given by equation (3)

$$V_V = V_T - V_L \quad (3)$$

where $V_T$ is the total volume of the boiler and $V_L$ is as described for equation 2. Since $V_T$ wil be known and $V_L$ is derived from the actual liquid level in the boiler in accordance with equation (2), equation (3) yields $V_V$.

The volume of the liquid ($V_L$) in the boiler 11 is divided by the specific volume to derive $M_L$. In like manner, the volume of the vapor ($V_V$) in the boiler 11 is divided by the specific volume of the vapor to derive $M_V$.

The invention has been described in terms of a preferred embodiment as illustrated in FIG. 1. Specific components which can be used in the practice of the invention as illustrated in FIG. 1, such as temperature transducer 24, level transducer 15, flow transducer 61, flow sensor 62, flow controller 34 and control valve 68 are each well known, commercially available control components such as are described at length in Perry's Chemical Engineers Handbook, 4th Ed., chapter 22, McGraw-Hill. It is also noted that, while preferably the level controller 21 is implemented by means of a computer, the level controller 21 could also be implemented by means of a conventional analog controller if desired.

While the invention has been described in terms of the presently preferred embodiment, reasonable variations and modifications are possible by those skilled in the art and such modifications and variations are within the scope of the described invention and the appended claims.

That which is claimed is:

1. Apparatus comprising:

a boiler;

means for supplying feedwater to said boiler;

means for withdrawing steam from said boiler means for establishing a first signal representative of the actual liquid level in said boiler;

means for establishing a second signal representative of the desired liquid level in said boiler;

means for comparing said first signal and said second signal and for establishing a third signal which is responsive to the difference between said first signal and said second signal, wherein said third signal is scaled so as to be representative of the flow rate of said feedwater required to maintain the actual liquid level in said boiler substantially equal to the desired liquid level represented by said second signal;

means for establishing a fourth signal representative of the actual enthalpy of the fluid in said boiler;

means for establishing a fifth signal representative of the desired enthalpy which the fluid in said boiler would have if the actual liquid level in said boiler were equal to the liquid level represented by said second signal;

means for comparing said fourth signal and said fifth signal and for establishing a sixth signal which is responsive to the difference between said fourth signal and said fifth signal, wherein said fifth signal is scaled so as to be representative of a change in the flow rate represented by said third signal required to maintain the actual enthalpy in said boiler substantially equal to the desired enthalpy represented by said fifth signal;

means for establishing a bias signal representative of the derivative of said sixth signal;

means for summing said third signal and said bias signal to establish a seventh signal representative of the desired flow rate of said feedwater; and means for manipulating the flow rate of said feedwater to said boiler in response to said seventh signal.

2. Apparatus in accordance with claim 1 wherein said means for establishing said fourth signal comprises;

means for establishing an eighth signal representative of the actual temperature of the fluid in said boiler;

means for establishing the enthalpy of the liquid in said boiler ($h_L$), the enthalpy of the vapor in said boiler ($h_V$), the mass of the liquid in said boiler ($M_L$) and the mass of the vapor in said boiler ($M_V$) in response to said first signal and said eighth signal; and means for establishing said fourth signal in accordance with equation (1)

$$h_{avg} = \frac{(h_V)(M_V) + (h_L)(M_L)}{M_V + M_L} \quad (1)$$

3. Apparatus in accordance with claim 2 wherein said means for controlling the flow of said feedwater in response to said seventh signal comprises:

a control valve operably located so as to control the flow of said feedwater;

means for establishing a ninth signal representative of the actual flow rate of said feedwater;

means for comparing said seventh signal and said ninth signal and for establishing a tenth signal which is responsive to the difference between said seventh signal and said ninth signal, wherein said tenth signal is scaled so as to be representative of the position of said control valve required to maintain the actual flow rate of said feedwater substantially equal to the desired flow rate represented by said seventh signal; and means for manipulating said control valve in response to said tenth signal.

4. A method for controlling the actual liquid level in a boiler to which feedwater is supplied and from which steam is withdrawn, said method comprising the steps of:

establishing a first signal representative of the actual liquid level in said boiler;

establishing a second signal representative of the desired liquid level in said boiler;

comparing said first signal and said second signal and establishing a third signal which is responsive to the difference between said first signal and said second signal, wherein said third signal is scaled so as to be representative of the flow rate of said feedwater required to maintain the actual liquid level in said boiler substantially equal to the desired liquid level represented by said second signal;

establishing a fourth signal representative of the actual enthalpy of the fluid in said boiler;

establishing a fifth signal representative of the desired enthalpy which the fluid in said boiler would have if the actual liquid level in said boiler were equal to the liquid level represented by said second signal;

comparing said fourth signal and said fifth signal and establishing a sixth signal which is responsive to the difference between said fourth signal and said fifth signal, wherein said fifth signal is scaled so as to be representative of a change in the flow rate represented by said third signal required to maintain the actual enthalpy in said boiler substantially equal to the desired enthalpy represented by said fifth signal;

establishing a bias signal representative of the derivative of said sixth signal;

summing said third signal and said bias signal to establish a seventh signal representative of the desired flow rate of said feedwater; and manipulating the flow rate of said feedwater to said boiler in response to said seventh signal to thereby maintain a desired actual liquid level in said boiler.

5. A method in accordance with claim 4 wherein said step of establishing said fourth signal comprises;

establishing an eighth signal representative of the actual temperature of the fluid in said boiler;

establishing the enthalpy of the liquid in said boiler ($h_L$), the enthalpy of the vapor in said boiler ($h_V$), the mass of the liquid in said boiler ($M_L$) and the mass of the vapor in said boiler ($M_V$) in response to said first signal and said eighth signal; and establishing said fourth signal in accordance with equation (1)

$$h_{avg} = \frac{(h_V)(M_V) + (h_L)(M_L)}{M_V + M_L} \quad (1)$$

6. A method in accordance with claim 5 wherein said step of controlling the flow of said feedwater in response to said seventh signal comprises;

establishing a ninth signal representative of the actual flow rate of said feedwater;

comparing said seventh signal and said ninth signal and establishing a tenth signal which is responsive to the difference between said seventh signal and said ninth signal, wherein said tenth signal is scaled so as to be representative of the position of a control valve, operably located so as to control the flow of said feedwater, required to maintain the actual flow rate of said feedwater substantially equal to the desired flow rate represented by said seventh signal; and manipulating said control valve in response to said tenth signal.

* * * * *